US007566870B2

(12) United States Patent
Hasegawa et al.

(10) Patent No.: US 7,566,870 B2
(45) Date of Patent: Jul. 28, 2009

(54) MASS SPECTROMETER

(75) Inventors: Hideki Hasegawa, Tachikawa (JP); Yuichiro Hashimoto, Tachikawa (JP); Izumi Waki, Tokyo (JP)

(73) Assignee: Hitachi High-Technologies Corporation, Tokyo (JP)

( * ) Notice: Subject to any disclaimer, the term of this patent is extended or adjusted under 35 U.S.C. 154(b) by 272 days.

(21) Appl. No.: 11/446,141

(22) Filed: Jun. 5, 2006

(65) Prior Publication Data

US 2006/0289743 A1 Dec. 28, 2006

(30) Foreign Application Priority Data

Jun. 6, 2005 (JP) ..... 2005-164962

(51) Int. Cl.
*H01J 49/42* (2006.01)

(52) U.S. Cl. ..... 250/292; 250/282

(58) Field of Classification Search ..... 250/282, 250/290, 291, 292

See application file for complete search history.

(56) References Cited

U.S. PATENT DOCUMENTS

| | | | | |
|---|---|---|---|---|
| 2,939,952 | A | 6/1960 | Paul et al. | |
| 4,540,884 | A | 9/1985 | Stafford et al. | |
| 4,736,101 | A | 4/1988 | Syka et al. | |
| 5,420,425 | A | 5/1995 | Bier et al. | |
| 5,448,061 | A * | 9/1995 | Wells | 250/282 |
| 5,572,022 | A | 11/1996 | Schwartz et al. | |
| 6,020,586 | A | 2/2000 | Dresch et al. | |
| 6,600,154 | B1 * | 7/2003 | Franzen et al. | 250/282 |
| 6,627,876 | B2 * | 9/2003 | Hager | 250/282 |
| 6,707,033 | B2 * | 3/2004 | Okumura et al. | 250/281 |
| 6,884,996 | B2 * | 4/2005 | Senko | 250/282 |

FOREIGN PATENT DOCUMENTS

JP 2005-44594 7/2003

* cited by examiner

*Primary Examiner*—Jack I Berman
(74) *Attorney, Agent, or Firm*—Reed Smith LLP; Juan Carlos A. Marquez, Esq.

(57) ABSTRACT

A mass spectrometer capable of realizing a high-sensitivity ion analysis and a high ion selectivity performance. The mass spectrometer includes the ion source where ions are produced, the ion trap where ions are accumulated, isolated, dissociated, and ejected, the detector to detect ions to be detected, and the controller to control operations of the ion trap. It has the features that the total ion accumulation in or just before each period is calculated based on the result obtained from the mass spectrometry in the preceding period, and that in at least one out of all periods, the condition of voltage applied to the ion trap is corrected depending on the total ion accumulation. Compared to the related art, the mass spectrometer of the present invention provides much improved performance in analysis sensitivity and ion selectivity.

18 Claims, 16 Drawing Sheets

MASS SPECTROMETER

CLAIM OF PRIORITY

The present application claims priority from Japanese application JP 2005-164962 filed on Jun. 6, 2005, the content of which is hereby incorporated by reference into this application.

FIELD OF THE INVENTION

This invention relates to a mass spectrometer using an ion trap, and more particularly, to a mass spectrometer that can realize a high-sensitivity analysis of ion and a high ion selectivity by means of such ion trap.

BACKGROUND OF THE INVENTION

When a mass spectrometer is used for the purpose of proteome analysis, the MSn spectrometry that conducts mass spectrometry over multiple stages becomes important.

As a mass spectrometry method that makes MSn spectrometry possible, there is a three-dimensional quadrupole ion trap mass spectrometer. As disclosed in the patent document 1 (U.S. Pat. No. 2,939,952), the three-dimensional quadrupole ion trap is able to stably accumulate ions having a specific mass-to-charge ratio in the ion trap by applying RF voltage to the ion trap.

Further, the three-dimensional quadrupole ion trap, as disclosed in the patent document 2 (U.S. Pat. No. 4,540,884), makes it possible that accumulated ions in it is scanned with RF voltage amplitude, ions in the ion trap become unstable so as to be ejected sequentially according to mass-to-charge ratio. Mass spectrometry can thus be conducted by sequentially detecting the ejected ions Furthermore, the three-dimensional quadrupole ion trap, as disclosed in the patent document 3 (U.S. Pat. No. 4,736,101), also makes it possible that with supplemental AC voltage applied separately from RF voltage, only those ions of specific mass-to-charge ratio, which have specific frequency to oscillate resonantly by the supplemental AC voltage, are ejected from the ion trap. Mass resolution can thus be enhanced by detecting those ejected ions and putting them to mass spectrometry.

In addition, the technique disclosed in the patent document 3 (U.S. Pat. No. 4,736,101) permits MSn analysis by means of ion trap, an important analysis for proteome analysis. By resonant oscillation by supplemental AC voltage, all ions having other mass-to-charge ratios than those specific one are ejected from the ion trap, while only the specific ions are isolated in the ion trap. In the next period, the ions isolated by supplemental AC voltage are oscillated resonantly and collide with a bath gas inside the ion trap to induce dissociation of ions. These fragment ions are scanned by ramping voltage amplitude of the RF voltage and ejected sequentially to undergo mass spectrometry. By means of the above technique, it becomes possible to obtain more detailed data on the structure of specimen molecule by the fragmentation pattern.

The quadrupole linear ion trap disclosed in the patent document 4 (U.S. Pat. No. 5,420,425) is also capable of conducting MSn analysis just as the three-dimensional quadrupole ion trap is, and since it has a higher accumulation efficiency than the three-dimensional quadrupole ion trap, increased sensitivity can be realized. Further, mass resolution can be improved space charge effects by accumulated ions are much weaker than the three-dimensional trap.

Further, as disclosed in the patent document 5 (U.S. Pat. No. 6,020,586), a combination of the quadrupole linear ion trap and a time-of-flight mass spectrometer makes it possible to perform MSn analysis and high mass resolution in the time-of-flight mass spectrometer.

Furthermore, as disclosed in the patent document 6 (JP-A 2005-044594), providing a collision damping chamber between the quadrupole linear ion trap and the time-of-flight mass spectrometer improves convergency of energy and positions of ions introduced into the time-of-flight mass spectrometer, which enhances efficiency in introducing ions into the acceleration region of the time-of-flight mass spectrometer, realizing high-sensitivity analysis.

In addition, the disclosure in the patent document 7 (U.S. Pat. No. 5,572,022) is intended to reduce the effect of space charge inside the ion trap. The invention of the patent document 7 describes that time for accumulating ions into the ion trap is adjusted according to the total ion content known from the mass spectrometry conducted just before the introducing process, thereby reducing the effect of space charge inside the ion trap.

SUMMARY OF THE INVENTION

In the case of the methods in the patent documents 1 to 6, it may occur sometimes that the effect of the space charge caused by increase of ion content accumulated in the ion trap results in decreased efficiency of accumulation, isolation, dissociation, and ejection, and non-intentionally affects other ions outside the target mass range, which lowers in ion detection sensitivity and/or ion selectivity. As an example, FIG. 1 is used to explain about the lowering of ion selectivity during the ion isolation period due to the effect of space charge. When the ion isolation is conducted to the ions accumulated in the ion trap targeting the ions within a specific mass range, it depends on the ion amount inside the ion trap, but isolation may sometimes be made of the other ions not belonging to the target mass range as shown in FIG. 1. This phenomenon occurs because of the effect of space charge in the ion trap, the electric field actually applied to the ions is changed from the preset electric field.

The method of the patent document 7 controls the ion introduction amount by shortening the time for accumulation of ions into the ion trap, but this will result in decreased sensitivity.

With respect to the mass spectrometer using the ion trap, it is important to realize high-sensitivity analysis and high ion selectivity.

The mass spectrometer of the present invention calculates the total ion accumulation in the ion trap in or just before each period of accumulation, isolation, dissociation, and ejection on the basis of the result obtained from the mass spectrometry conducted in the immediately preceding period and corrects the reference value of voltage conditions for each mass-to-charge ratio preset in the controller, depending on the calculated total ion accumulation.

The present invention has the objective of realizing high-sensitivity analysis and high ion selectivity by the use of the ion trap mass spectrometer.

DETAILED DESCRIPTION OF THE PREFERRED EMBODIMENTS

First Embodiment

Figure 1:
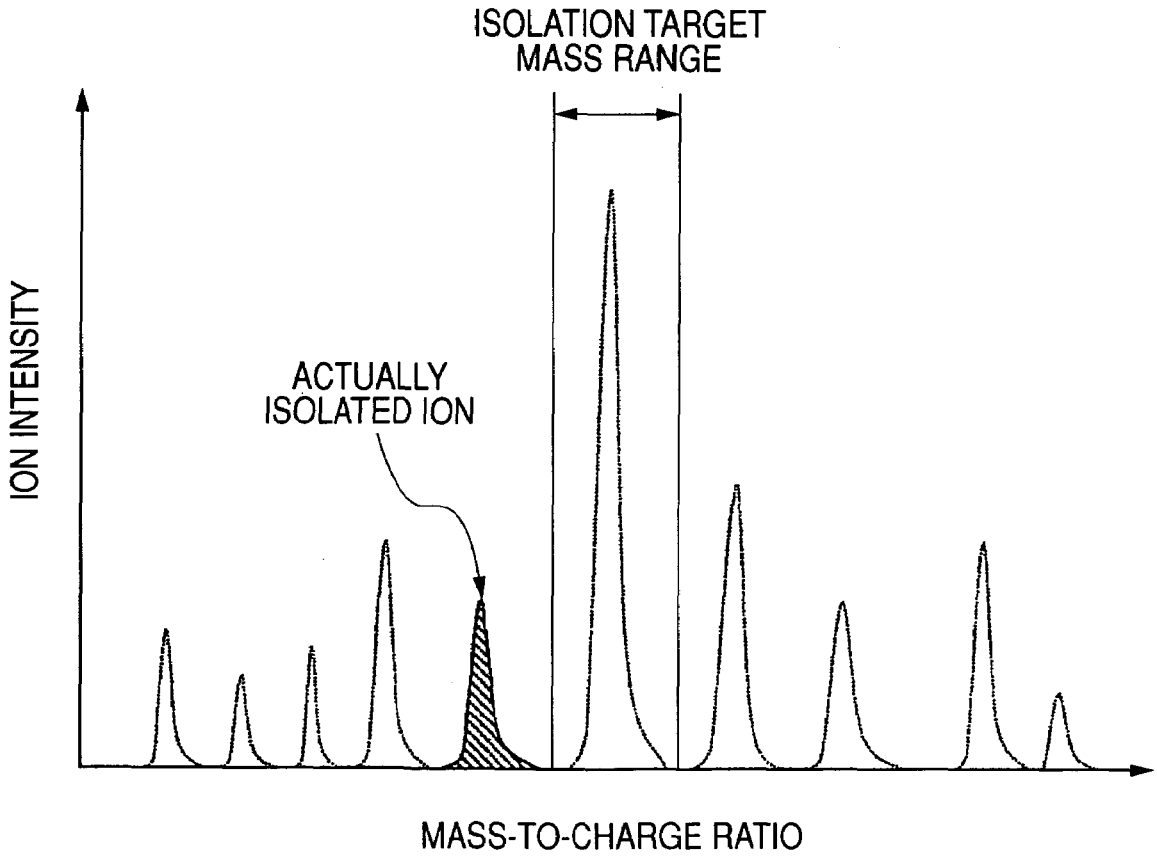
FIG. 1 is a graph explaining the problem of the conventional system.
Figure 2:
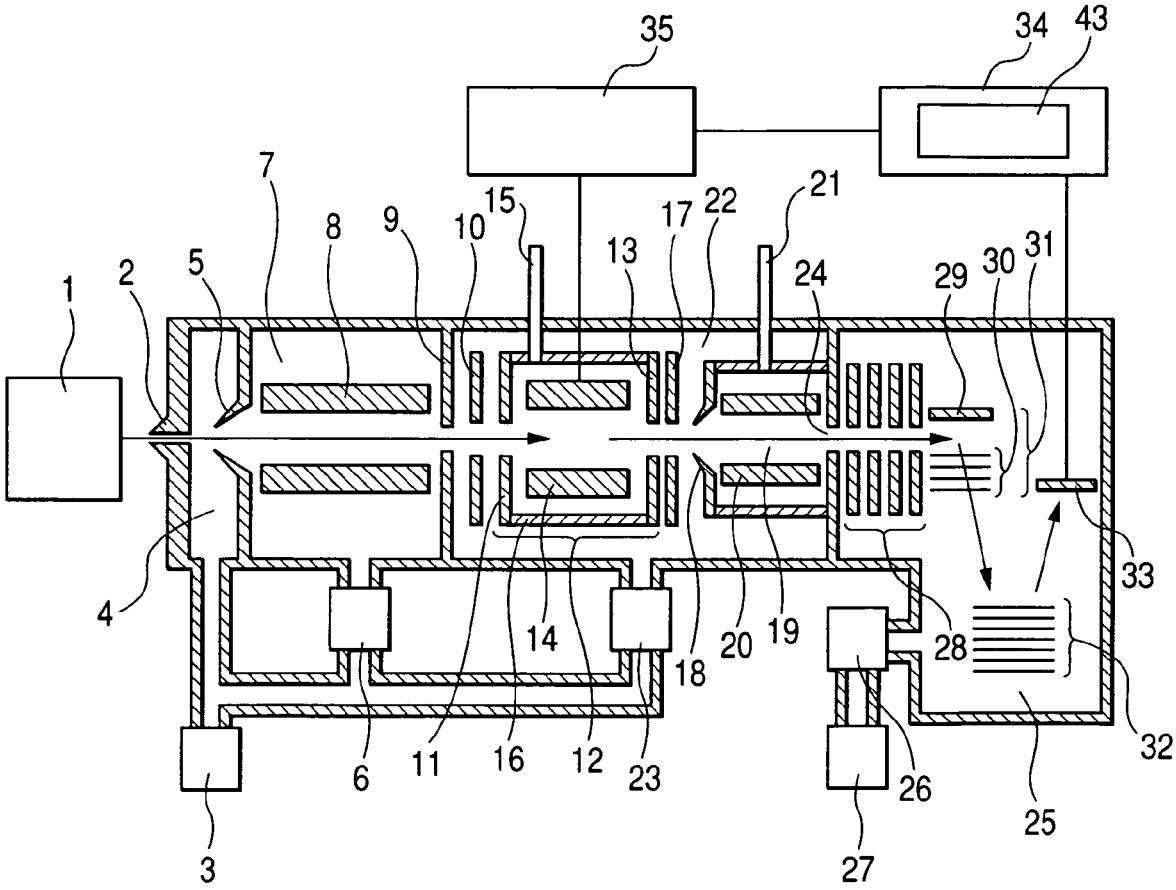
FIG. 2 is a drawing illustrating a first embodiment of the present invention.

FIG. 2 is a block diagram illustrating the quadrupole linear ion trap time-of-flight mass spectrometer according to the present invention.

Ions produced in the ion source 1 are moved through the aperture 2 and introduced into the first differential pumping region 4 where exhaust is made to maintain 100-500 Pa by the rotary pump 3. Then, ions are moved through the aperture 5 and introduced into the second differential pumping region 7 where exhaust is effected by the turbo molecular pump 6. The second differential pumping region 7 is provided with the multipole electrode 8 and is maintained at a pressure of about 0.3-3 Pa. To the multipole electrode 8, an alternately phase-reversing frequency of about 1 MHz and a RF voltage with voltage amplitude of several hundred volts are applied. Ions are converged to near the center axis within the multipole electrode 8 for highly efficient transport.

The ions converged in the multipole electrode 8 are led through the aperture 9, the holes of the gate electrodes 10, and the incap electrodes 11 into the linear ion trap 12. The linear ion trap 12 comprises the incap electrode 11, the endcap electrode 13, and the quadrupole rod electrodes 14. Into the linear ion trap 12, helium or other neutral gas is introduced through the piping 15. The linear ion trap 12 makes up the inside of the case 16 which keeps a pressure of about 0.03-0.3 Pa inside. The ions that have undergone the periods of accumulation, isolation, and dissociation are led through the endcap electrodes 13 before they are ejected out of the linear ion trap 12.

The ejected ions are led through the ion stop electrodes 17 & 18 into the collisional damping chamber 19. The collisional damping chamber 19 is provided with the multipole electrodes 20, and it receives helium or other neutral gas through the piping 21 so as to keep a pressure of about 10 Pa. To the multipole electrodes 20, a RF voltage having an alternately phase-reversing frequency of about 2 MHz and a voltage amplitude of about 1 kV are applied. In the collisional damping chamber 19, the ions lose energy by collisions and converge finally. The linear ion trap 12 and the collisional damping chamber 19 are located inside the vacuum chamber 22, which is exhausted by the turbo molecular pump 23 so as to be maintained at about $1\times10^{-3}$ Pa. The exhaust from the turbo molecular pumps 6 & 23 is discharged by the rotary pump 3.

The ions converged in the collisional damping chamber 19 are led through the aperture 24 into the TOF chamber 25, which is exhausted by the turbo molecular pump 26 to maintain a pressure of $2\times10^{-4}$ Pa, The exhaust from the turbo molecular pump 26 is exhausted by the rotary pump 27. The ions then pass through the lens electrode 28 composed of a plurality of electrodes and reach the acceleration region 31 composed of the pusher 29 and the pull electrodes 30. The pusher 29 is given an accelerating voltage in cycles of about 1-10 kHz and thereby accelerated in the orthogonal direction of the introduction direction. The accelerated ions are reflected by the reflectron 32 and detected upon reaching the detector 33. Each ion has a different time of flight depending on the ion mass. Thus, the mass spectrum that can be known from the time of flight and the signal intensity is to be recorded in the storage unit 43 located in the controller 34.

The operation of the linear ion trap 12 is controlled by the controller 34. In the controller 34, voltage conditions for the target ion mass to be used as reference in each period of accumulation, isolation, dissociation, or ejection are preset and stored in the storage unit, for example, in the form of a table. The controller 34 controls the power source 35 in accordance with preset voltage conditions.

Figure 3:
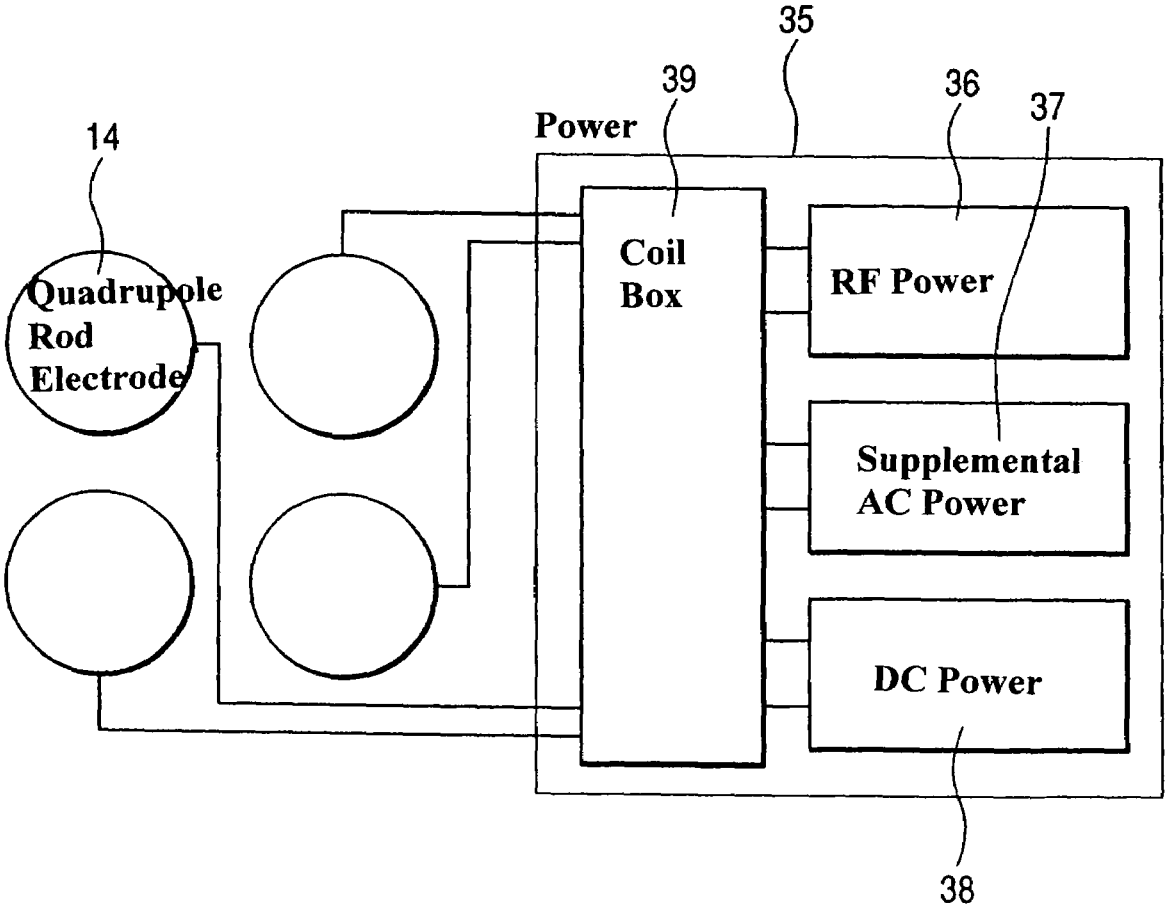
FIG. 3 is a drawing illustrating the voltage charging system of the first embodiment.

FIG. 3 is used to explain about the method of applying voltage to the linear ion trap 12. The power source 35 is composed of the RF power source 36, the supplemental AC power source 37, the DC power source 38, and the coil box 39. The RF power source 36 applies to the quadrupole rod electrode 14 a RF voltage having an alternately phase-reversing frequency of about 800 kHz and a voltage amplitude of about 5 kV. The supplemental AC power source 37 applies a RF voltage having a frequency of about 5-350 kHz and a voltage amplitude of about ±35V between a pair of oppositely standing rod electrodes. The DC power source 38 applies an offset voltage of about 10-20 V to all of the quadrupole rod electrodes 14. The coil box 39 serves for amplification of voltage.

Figure 4:
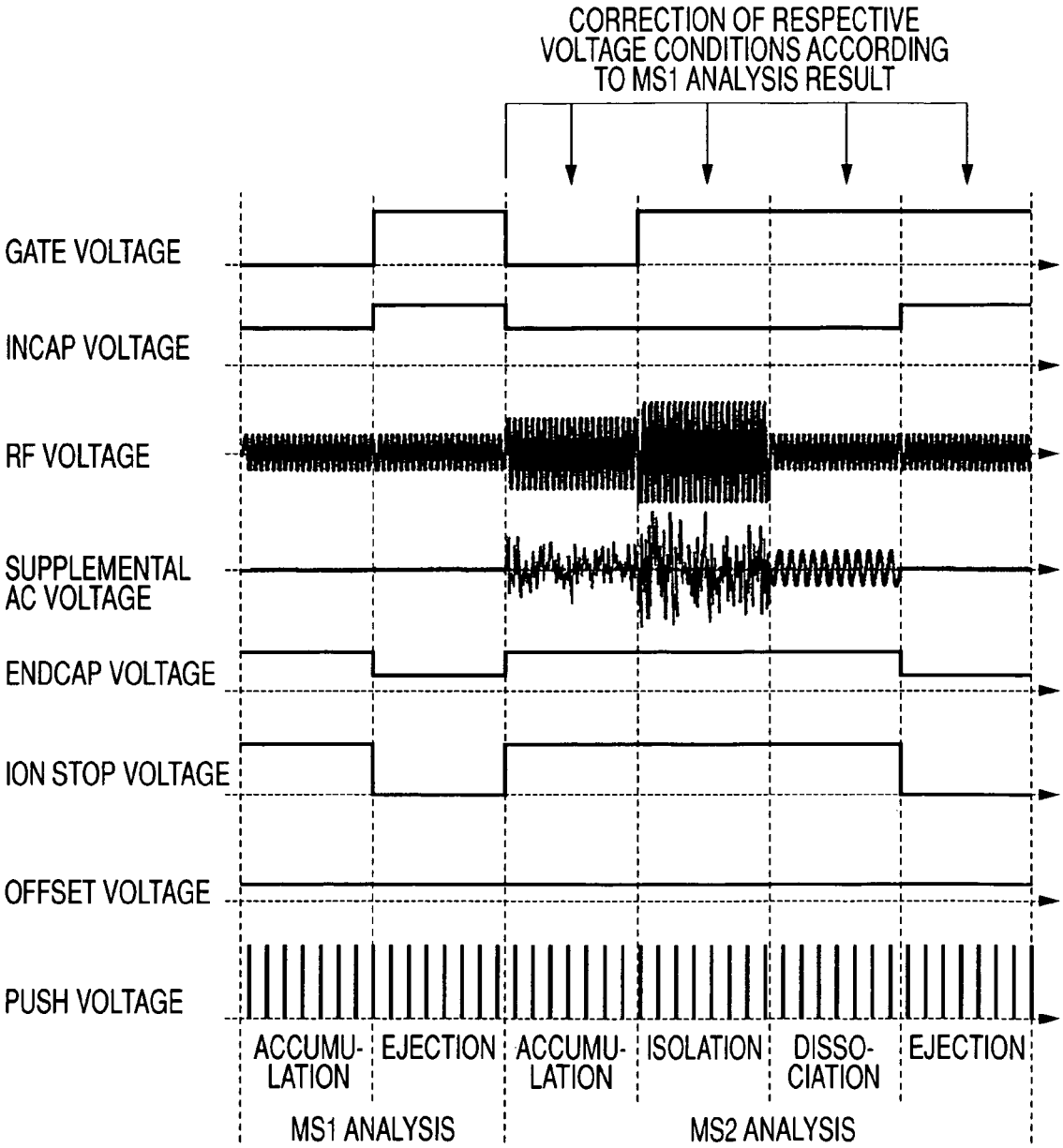
FIG. 4 is an operational sequence diagram of the first embodiment.

FIG. 4 is used to explain about the operational sequences of each electrode when MSn spectrometry is conducted in the linear ion trap 12. The operational sequence diagram in FIG. 4 shows the measurement sequence of MS2 analysis. With regard to this MS2 analysis, the linear ion trap 12 conducts ion accumulation and ejection in MS1 analysis, the first mass spectrometry process, and in MS2 analysis, the second mass spectrometry process, it does ion accumulation, isolation, dissociation, and ejection. Typically, in MS1, time duration is 20 ms for accumulation and 1 ms for ejection; in MS2, 20 ms for accumulation, 5 ms respectively for isolation and dissociation, and 1 ms for ejection.

In MS1 ion accumulation period, a trap potential is formed by the radial potential created by the RF voltage applied to the quadrupole electrode 14 and the axial potential created by the difference in potential (10-20 V) between the offset voltage of the quadrupole rod electrode 14 (10-20 V) and the incap voltage of the incap electrode 11 (30 V) and the endcap voltage of the endcap electrode 13 (30 V); and the aforementioned trap potential traps ions in the ion trap 12. During the above process, ions lose their energy owing to collisions with the neutral bath gas inside the linear ion trap 12 and are accumulated stably near the center axis of the linear ion trap 12. In this MS1 ion accumulation period, ions are led into the linear ion trap 12 at a high efficiency by setting the gate voltage of the gate electrode 10 at a low value (0 V), and ions are prevented from slipping out of the linear ion trap 12 by setting the ion stop voltage of the ion stop electrode 17 at a high value (50 V). In addition, by the function of the RF voltage applied to the quadrupole electrode 14, those ions whose mass is under a certain level dependent on the voltage amplitude are ejected without being accumulated in the linear ion trap 12 (LMCO=low mass cut off). Commonly, LMCO is set relatively low in MS1 ion accumulation period so that ions of a wide range of mass can be accumulated.

In MS1 ion ejection period, the incap voltage is set at a high value (50 V), and the endcap voltage is set at a low value (10 V) so as to eject ions toward the direction of the collisional damping chamber. Also in MS1 ion ejection period, the gate voltage is set at a high value (50 V) so as to prevent ions from getting into the linear ion trap 12, and the ion stop voltage is set at a low value (0 V) so as to allow ions to pass the ion stop electrode 17 at a high efficiency. The ejected ions are subjected to mass spectrometry in the TOF chamber according to the method explained in FIG. 2.

Explanation given below is concerning MS2 analysis. In MS2 analysis, the precursor ion mass for the tandem mass spectrometry is determined from the mass spectrum obtained in MS1 analysis, and corresponding to such ion mass, the voltage conditions are preset in the controller 34. The mass spectrometry is conducted in the isolation and dissociation periods based on such voltage conditions to ascertain the mass of dissociated ions and further to clarify detailed data on the structure.

In MS2 ion accumulation period, the supplemental AC voltage is applied to the quadrupole rod electrode 14 in order to reduce the influence of space charge effect caused by saturated ions in the linear ion trap 12. Commonly, the associated wave of AC voltage (e.g. FNF etc.), with which those ions belonging to other mass range than that of isolation target ions can have resonant oscillation, is used. This associated wave is composed of such notch-shaped frequency component that does not contain only the frequency range accommodating resonant oscillation with the ions of target mass range, so that by the action of resonant oscillation, ions in the wide mass range other than the target mass range may be ejected out of the linear ion trap 12. In this way, only those ions whose mass-to-charge ratio (m/z) is in the target mass range are isolated in the linear ion trap 12. Mostly in the accumulation period, ions do not completely lose energy because of insufficient collisions against neutral gas, and therefore, the notch width is set broadly to avoid the target ions from being ejected. For this reason, it may occur sometimes that ejection is not necessarily performed efficiently but allows some ions belonging to other than the target mass range to remain in the linear ion trap 12. Also, generally in MS2 ion accumulation period, LMCO is set at a level higher than in MS1 accumulation period so that those ions whose mass is sufficiently lower than that of the target ions may be excluded.

In MS2 ion isolation period, only the ions belonging to the target mass range are left in the linear ion trap 12 while all other ions are efficiently ejected out of the linear ion trap 12, with an increased precision than in MS2 ion accumulation period. The method of ejection is almost the same as in MS2 ion accumulation period, but different values are used for the voltage amplitude of the RF voltage applied to the quadrupole rod electrode 14 and the voltage amplitude and frequency component of the-supplemental AC voltage. In the isolation period, both the incap voltage and the endcap voltage are maintained at 30 V, and the offset voltage to the quadrupole rod electrode 14 is maintained at 10-20 V, so that the ions covered by the target mass range may be accumulated stably in the ion trap 12 by means of the trap potential. Also, setting of the gate voltage and the ion stop voltage at a high value (50 V) prevents ions from getting into or passing through the linear ion trap 12. Since ejection in this period is conducted for the ions that have amply lost energy through collisions against neutral gas in the accumulation period, it can be done with high precision and at high efficiency, permitting isolation of only the target ions within a range below ±1 m/z in relation to the mass-to-charge ratio (m/z). In MS2 ion isolation period, LMCO is set at a higher level than in the accumulation period.

In MS2 ion dissociation period, the supplemental AC voltage is applied to the quadrupole rod electrode 14 to cause resonant oscillation of the ions isolated in the linear ion trap 12 during the isolation period, thereby causing collisions more than once between the neutral bath gas and the ions in the linear ion trap 12. Collisions make the ions fragmented. In the dissociation period, a supplemental AC voltage of the frequency that can cause resonant oscillation of only the isolated ions is applied, and it is no longer necessary to overlay a plurality of frequency components. Also, in order to prevent the target ions and fragmented ions from being ejected out of the linear ion trap 12, LMCO and preset conditions for the voltage amplitude value of the supplemental AC voltage are set at lower levels than in the isolation period. Additionally, the voltage conditions for the incap voltage, the endcap voltage, the gate voltage, and the ion stop voltage can be all the same as in the isolation period.

The voltage conditions for MS2 ion ejection period are the same as for MS1 ion ejection period. All the ions fragmented in the dissociation period are ejected and undergo the mass spectrometry in accordance with the principles explained in FIG. 2. From the state of the mass spectrum available as a result of fragmentation, it becomes possible to analyze the structural data more in detail than the mass spectrum obtainable in MS1 analysis.

In the present invention, calculation is made of the total ion accumulation in the linear ion trap 12 in or just before each period, in at least one period out of MS2 ion accumulation, isolation, dissociation, and ejection periods, based on the mass spectrum and other data regarding ion content, and then, depending on the calculated total ion accumulation, correction is made of at least one out of the reference values of the voltage conditions preset for each electrode in the controller 34; the voltage conditions after correction are thus to control the power supply 35 and the linear ion trap 12. In the above manner, it becomes possible to subdue the influence of space charge without changing the time of MS2 ion accumulation and thereby to satisfy both of high-sensitivity analysis and high ion selectivity. Estimation of total ion accumulation is conducted by comparing time, LMCO, notch width (mass range) of the supplemental voltage, and other conditions of each MS2 period against the conditions of MS1 accumulation period. Concrete estimation method is explained below with reference to actual cases.

The correction system according to this invention is explained below with examples. Explained firstly is a case of MS2 ion accumulation period. This case is successful in restraining the influence of space charge and realizing high sensitivity and high ion selectivity by making correction of the supplemental AC voltage in MS2 accumulation period.

Figure 5:
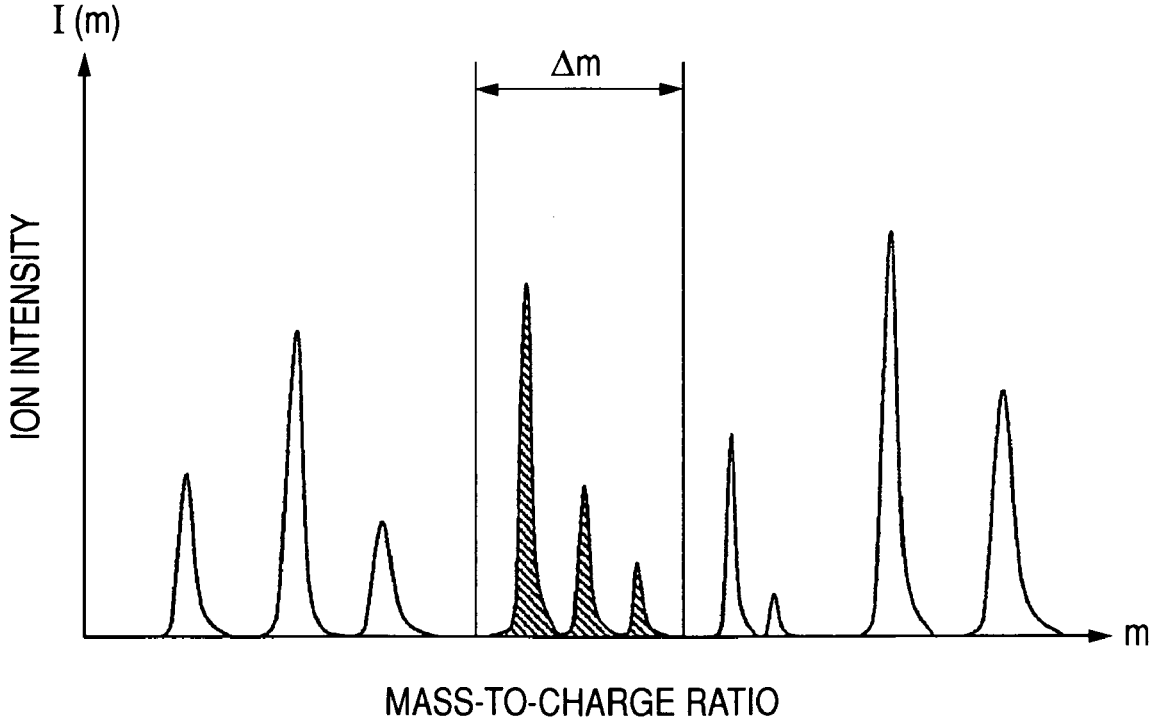
FIG. 5 is a graph explaining the calculation method for ion accumulation of the present invention.

Firstly, explanation on how to estimate the ion accumulation in MS2 accumulation period is given in reference to FIG. 5. FIG. 5 shows the mass spectrum obtained from MS1 analysis, with the target mass range in the accumulation period of MS2 analysis marked as Δm. This Δm is determined by LMCO and the notch width of the supplemental AC voltage.

Assuming the vertical axis I(m) is a function of the horizontal axis "m," the ion accumulation "Q" covered by the range Δm can be estimated by Formula 1.

$$Q = \int^{\Delta m} I(m)dm \cdot \frac{T_{ms2}}{T_{MS1}} \quad \text{[Formula 1]}$$

$T_{MS1}$ means the total time span of the accumulation period of MS1 analysis, and $T_{ms2}$ means the time at the instant of estimating the ion accumulation during the accumulation period of MS2 analysis. Now, assuming $T_{MS2}$ is the total time span of the accumulation period of MS2 analysis, $T_{ms2}$ is considered to be in the range of 0-$T_{ms2}$. In other words, "Q" in the case of $T_{ms2}$=0 means the ion accumulation just before the accumulation period; "Q" in the case of $T_{ms2}$=$T_{MS2}$ means the ion accumulation just after the accumulation period (just before the isolation period); and "Q" in the case of $0<T_{ms2}<T_{MS2}$ means the ion accumulation during the accumulation period. Actually, the ion accumulation during the accumulation period keeps on varying with time, in the following examples an average value of "Q" during 0-$T_{MS2}$ is assumed to be a total ion content of the accumulation period.

Figure 6:
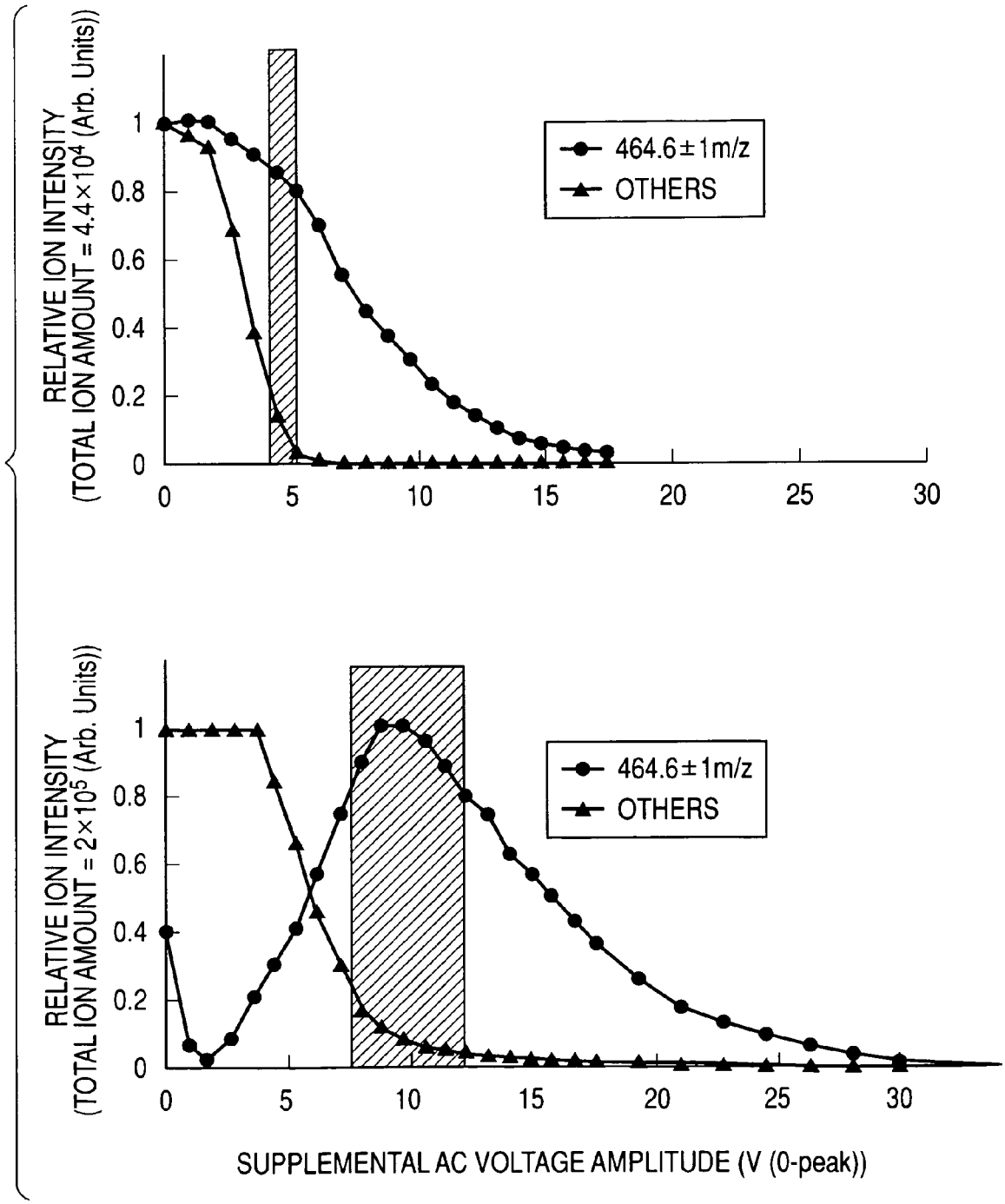
FIG. 6 is a graph explaining the effect of the present invention.

FIG. 6 shows the dependency on the supplemental AC voltage in MS2 ion accumulation period. The result shown in FIG. 6 has been obtained from 5-kind mixed peptide and that any other ions than ones having a mass-to-charge ratio of 464.6 m/z are excluded with the supplemental AC voltage. The total ion accumulation in MS2 accumulation period estimated from the MS1 mass spectrum and by Formula 1 is $4.4\times10^4$ and $2\times10^5$ (Arb. Units) respectively, as compared to 450 m/z or over, the actually adopted reference index of total ion content. If the condition that the ions of 464.6±1 m/z should remain by 80% or more, while other ions should be excluded to the extent of a remaining portion being 20% or less, is taken as optimum, the optimum value of voltage amplitude for the supplemental AC voltage comes out differently; that is, it should be 4-5 V in case the total ion accumulation is $4.4\times10^4$, and 8-12 V (0-peak ) in case the total ion accumulation is $2\times10^5$. This indicates that the optimum condition for the supplemental AC voltage becomes different, affected by the difference in the total ion accumulation in the linear ion trap in MS2 ion accumulation period. The reason for this is that as ions in the linear ion trap 12 reach a state near saturation, the effect of space charge deriving from the charge on ions causes apparent decrease of the supplemental AC voltage when actually received by ions.

Figure 7:
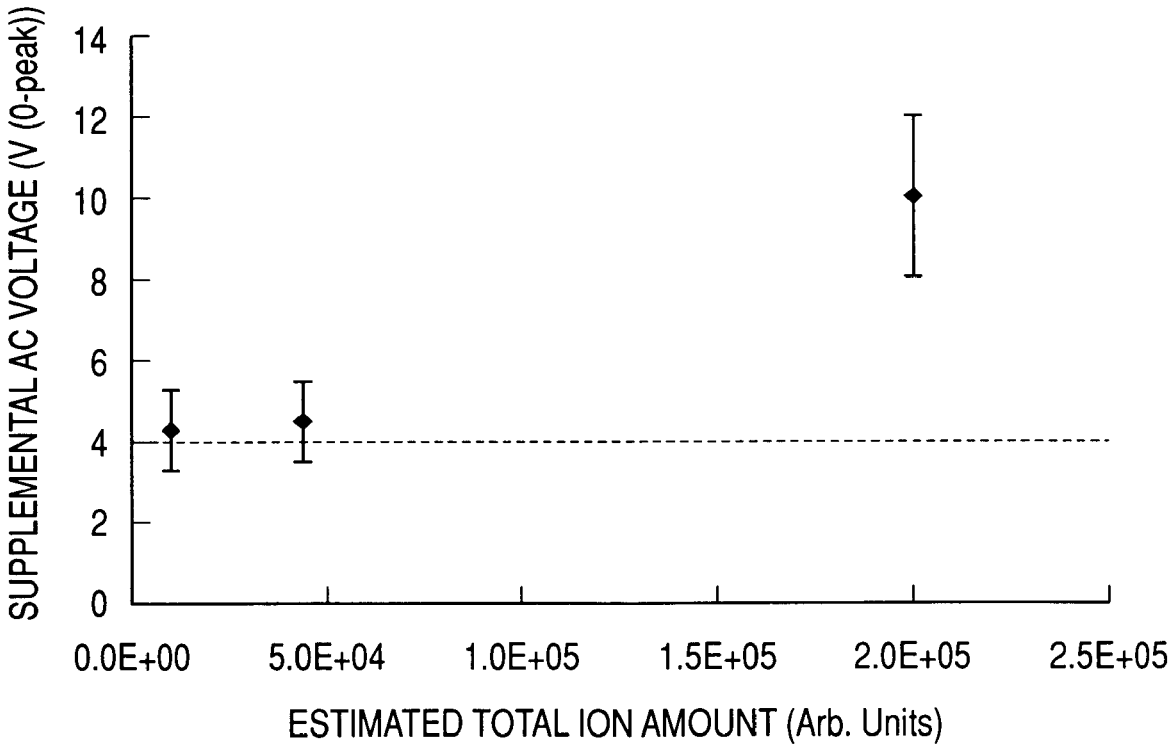
FIG. 7 is a graph explaining the effect of the present invention.

In the graph of FIG. 7, the total ion accumulation in MS2 accumulation period estimated by MS1 mass spectrum and Formula 1 is plotted along the horizontal axis, and the optimum value of the voltage amplitude of the optimum supplemental AC voltage is plotted along the vertical axis. From FIG. 7, the optimum value of the voltage amplitude of the supplemental AC voltage for the estimated total ion accumulation can be calculated. In the present embodiment, the reference value of the voltage amplitude of the supplemental AC voltage preset in the controller 34 is set at an optimum value (voltage amplitude value=about 4 V (0-peak)) on the condition that the linear ion trap 12 is little affected by the effect of space charge (in FIG. 7, the condition is that the ion accumulation should be $1\times10^4$ or less)

Figure 8:
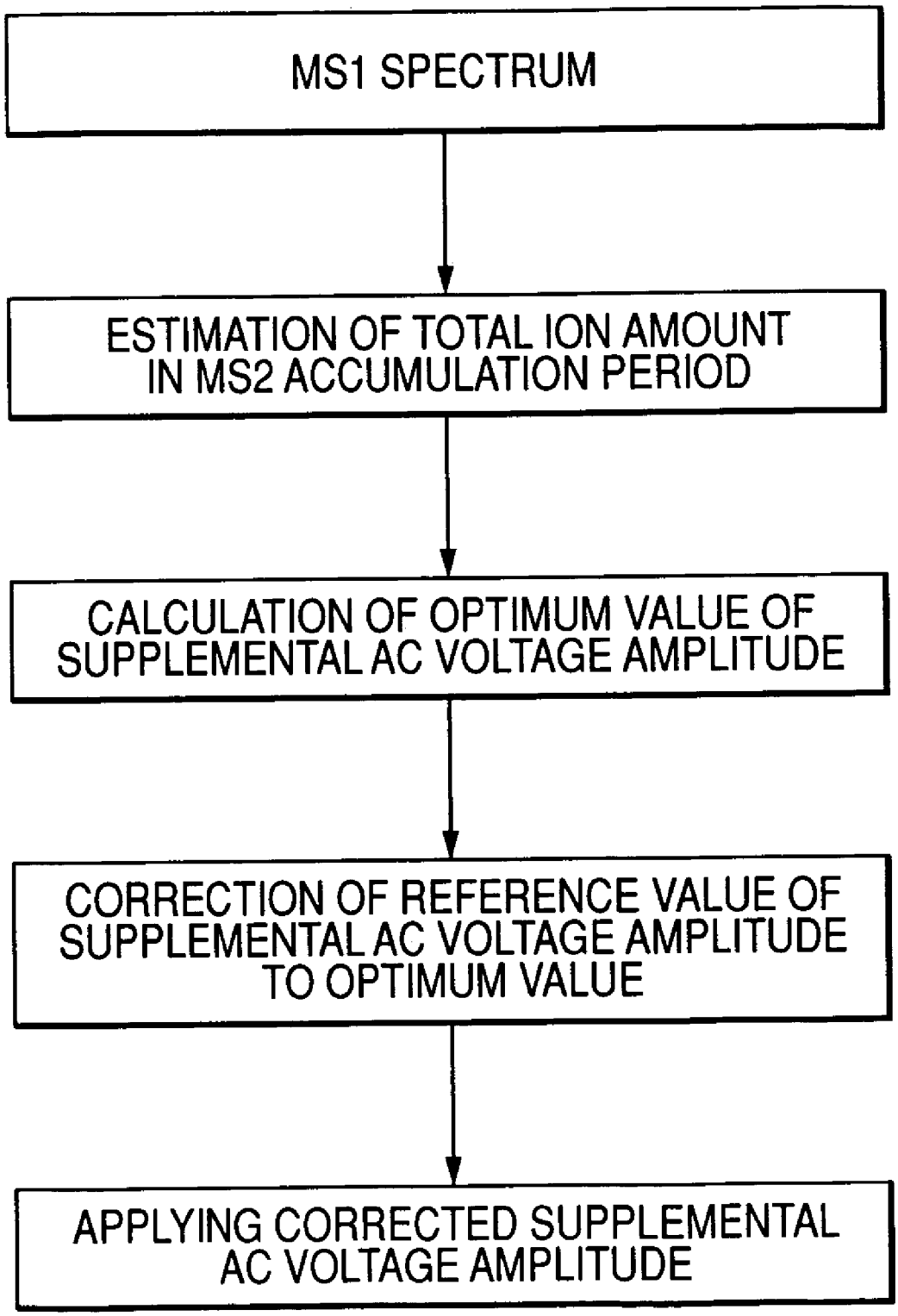
FIG. 8 is a flowchart of the first embodiment.

As shown in the flowchart of FIG. 8, firstly, the total ion accumulation in MS2 accumulation period is estimated by Formula 1 and from the result of MS1 analysis; secondly, based on the estimated total ion accumulation, the optimum voltage amplitude value of the supplemental AC voltage is calculated; thirdly, the reference value of the supplemental AC voltage preset for every m/z in the controller 34 is corrected to the optimum value; fourthly, the power source 35 and the linear ion trap 12 are controlled by the voltage amplitude value after correction; thereby making it possible to control the effect of space charge in the linear ion trap 12 and to accurately accumulate the ions in the target mass range. For calculation of the optimum value here, it will be convenient and easy to calculate the optimum value based on the MS1 ion accumulation data, if the relation between the estimated ion accumulation and the optimum voltage value is recorded in the form of function data or table in the controller section.

Ions are accumulated in the linear ion trap 12 by the potential created by the RF voltage, and those ions that override the potential are not accumulated. According to the ion accumulation level, the potential becomes distorted, and the apparent depth of the potential varies to cause difference in the optimum voltage condition.

Assuming that "D" represents the depth of the potential, "$m_{target}$" represents the target ion mass, and "V" represents the voltage amplitude value of the RF voltage, the following Formula 2 can be set up.

$$D \propto m_{target} \propto V \quad \text{[Formula 2]}$$

Further, by differentiating "D" of Formula 2 with "$dm_{target}$" and "dV," the following Formula 3 is obtained.

$$\frac{dD}{D} \propto \left|\frac{dm_{target}}{m_{target}}\right| \propto \left|\frac{dV}{V}\right| \quad \text{[Formula 3]}$$

As "dD" of Formula 3 stands for distortion of the potential, it depends on the ion accumulation "Q" obtained from Formula 1, thus leading to Formula 4.

$$dD \propto Q \quad \text{[Formula 4]}$$

From Formulas 2, 3, and 4, the following Formula 5 is obtained.

$$dm_{target} \propto dV \propto Q \quad \text{[Formula 5]}$$

In short, it has been proved that the deviation from the target ion mass "$dm_{target}$" and the deviation from the optimum RF voltage condition "dV" depend not on the target ion mass "$m_{target}$," but on the ion accumulation "Q." As the supplemental AC voltage in MS2 accumulation period is an associated wave, it cannot be expressed with a simple formula, but like the RF voltage, it is considered not depending on the target ion mass "$m_{target}$." Therefore, the system in the present embodiment is valid irrespective of the target ion mass.

The foregoing has explained about the example of estimating the total ion accumulation in MS2 ion accumulation period based on the result of MS1 analysis and then correcting the supplemental AC voltage in MS2 ion accumulation period to the optimum condition. Similar correction methods are equally useful for MS2 ion isolation period, too.

In the next place, examples are explained with respect to MS2 ion isolation period according to the present invention. The following is an example where high sensitivity and high ion selectivity can be realized by correcting RF voltage in MS2 isolation period, even though the ions in the linear ion trap 12 are situated under the influence of space charge.

In the beginning, the method of estimating the ion accumulation just before MS2 isolation period is explained. This estimation method is almost the same as used for MS2 accumulation period, and estimation can be made by Formula 1.

"$T_{MS1}$" stands for the entire time span of the accumulation period in MS1 analysis, and "$T_{ms2}$" stands for the instant of time when the ion accumulation is estimated in the accumulation period of MS2 analysis. Assuming here that "$T_{MS2}$" means the entire time of the accumulation period in MS2 analysis, "$T_{ms2}$" is considered to be positioned within the range of "0-$T_{MS2}$" In other words, "Q" in the case of $T_{ms2}=T_{MS2}$ is estimated to be the ion accumulation just after the accumulation period (just before the isolation period). The variation with time of the ion accumulation in the midway of MS2 isolation period is not a linear variation, unlike in the accumulation, and for that reason, the ion accumulation in the midway of the isolation period is hard to estimate. Therefore, in the present embodiment, the ion accumulation is estimated just before the isolation period.

Figure 9:
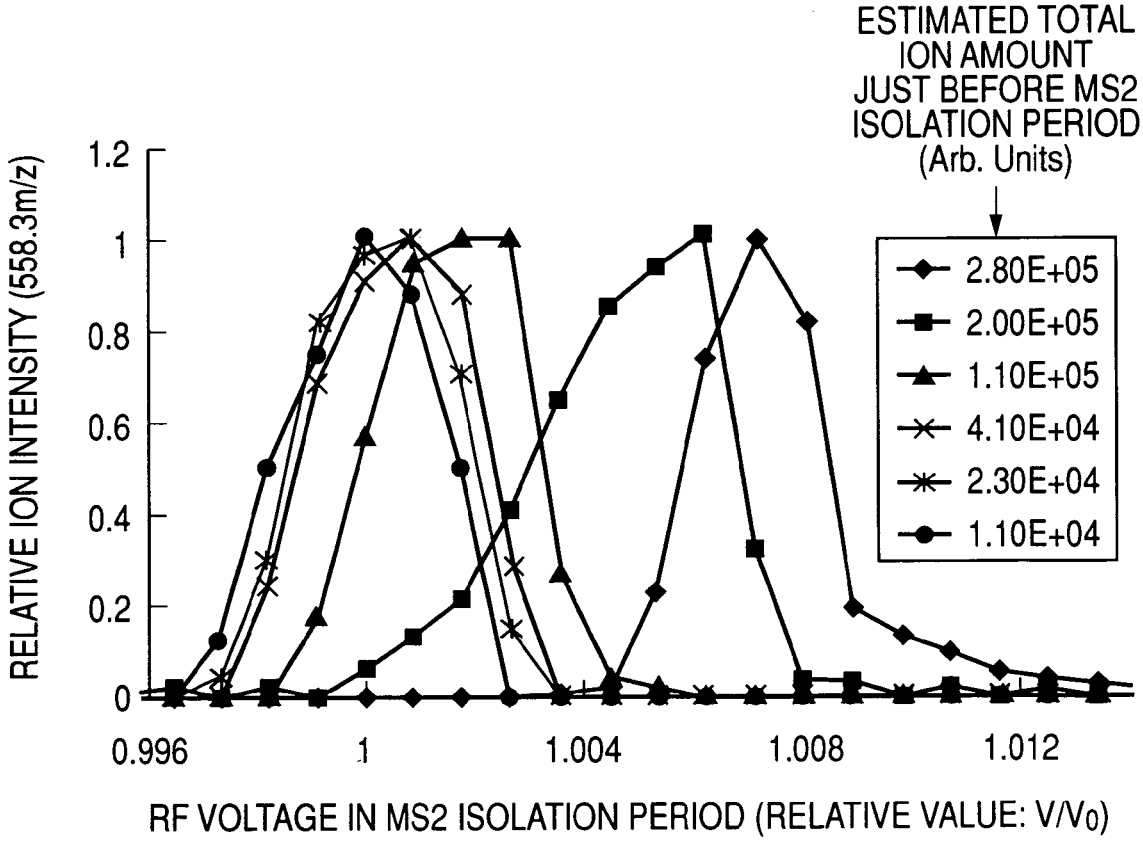
FIG. 9 is a graph explaining the effect of the present invention.

FIG. 9 shows the result of isolation performance in relation to difference in the total ion accumulation in the MS2 ion isolation period. The isolation period of FIG. 9 is under the condition that the ion accumulation just before MS2 isolation period is $1\times10^4$ or below and there is little effect of space charge. In this figure, the horizontal axis stands for "$V/V_0$," namely the ratio of voltage amplitude value for various conditions "V" to the voltage amplitude value of the RF voltage in the isolation period; and the vertical axis stands for the relative ion intensity of trivalent ion (mass-to-charge ratio 558.3 m/z) of neurotensin, the isolation target. This graph in FIG. 9 indicates that the RF voltage condition on which the isolation target ions remain without being excluded and the ion intensity becomes the strongest, is different depending on the estimated total ion accumulation just before the isolation period.

Figure 10:
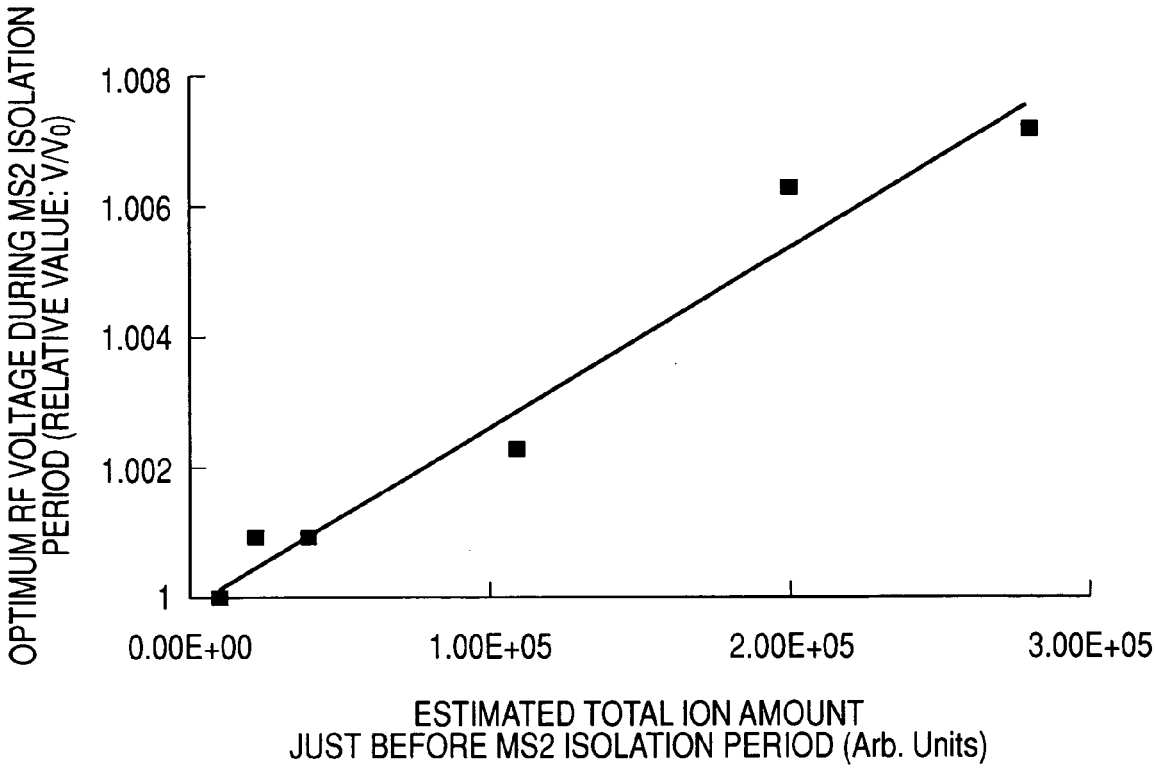
FIG. 10 is a graph explaining the effect of the present invention.

In FIG. 10, the estimated total ion accumulation just before MS2 isolation period is plotted along the horizontal axis, and the optimum $V/V_0$ at which the ion intensity of 558.3 m/z becomes the strongest is plotted along the vertical axis. From FIG. 10, it is possible to calculate the optimum value of the voltage amplitude value of the RF voltage for the estimated total ion accumulation. In the present embodiment, the reference value of the voltage amplitude value of the RF voltage preset in the controller 34 is set at the optimum value ($V/V_0=1$) on condition that the linear ion trap 12 is almost free from the effect of space charge (the condition in FIG. 10 is the ion accumulation=$1\times10^4$ or below).

Figure 11:
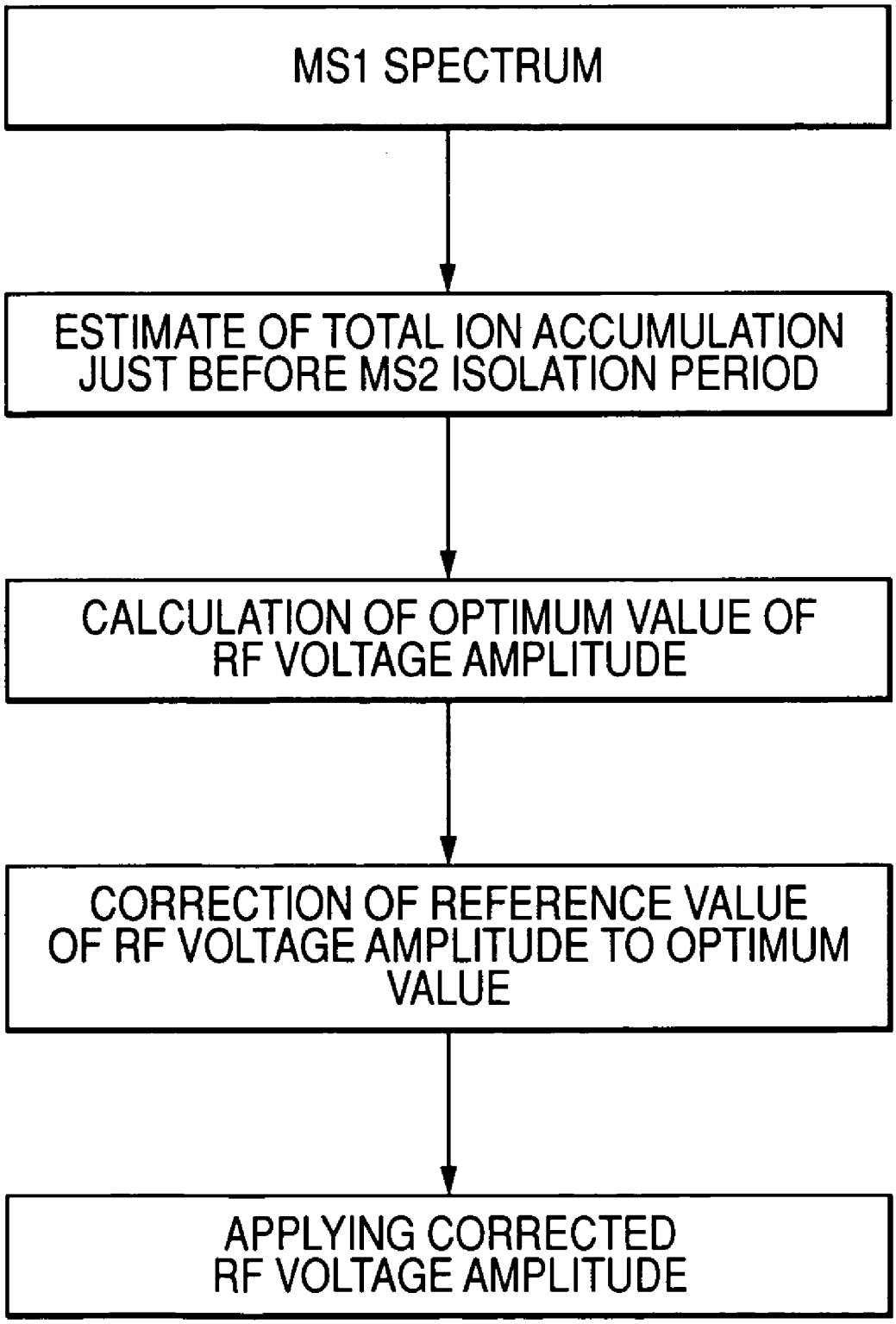
FIG. 11 is a flowchart of the first embodiment.

As shown in the flowchart of FIG. 11, firstly, the total ion accumulation just before MS2 isolation period is estimated by Formula 1 from the result of MS1 analysis; secondly, based on the estimated total ion accumulation, the optimum voltage amplitude value of the RF voltage is calculated; thirdly, the reference value of the RF voltage amplitude preset for every m/z in the controller 34 is corrected to the optimum value; fourthly, the power source 35 and the linear ion trap 12 are controlled by the voltage amplitude after correction; thereby making it possible to control the effect of space charge in the linear ion trap 12 and to accurately isolate the ions in the target mass range. As in the accumulation period, Formula 5 is also valid for the present embodiment, and it proves that the deviation from the target ion mass "$dm_{target}$" and the deviation from the optimum RF voltage condition "dV" depend not on the target ion mass "$m_{target}$," but on the ion accumulation "Q." Therefore, the system in the present embodiment is valid irrespective of the target ion mass.

The foregoing presents explanation concerning the example of estimating the total ion accumulation just before MS2 ion isolation period from the result of MS1 analysis and correcting the RF voltage in MS2 isolation period to the optimum condition. The correction method in the present invention is valid not only for MS2 ion accumulation and isolation periods but also for the dissociation and ejection periods.

Such correction of the voltage condition of the linear ion trap 12 as in the present invention becomes necessary, because the voltage which the ions actually receive in the linear ion trap 12 turns out to be apparently lower than the preset voltage. Since the system of the present invention is a method to correct an apparent voltage, it is valid also as a method for correcting not only the voltage amplitude of the RF voltage and the supplemental AC voltage, but also a combination of frequency components of the supplemental AC voltage, the offset voltage of the quadrupole rod electrode 14, or the incap voltage and the endcap voltage.

As shown by the operational sequence of the present invention, correction of the voltage condition of the linear ion trap 12 depending on the estimated total ion accumulation in and just before each MS2 period reduces the effect of space charge and realizes high sensitivity and high ion selectivity for all conditions where the total ion accumulation takes largely different values.

Second Embodiment

Figure 12:
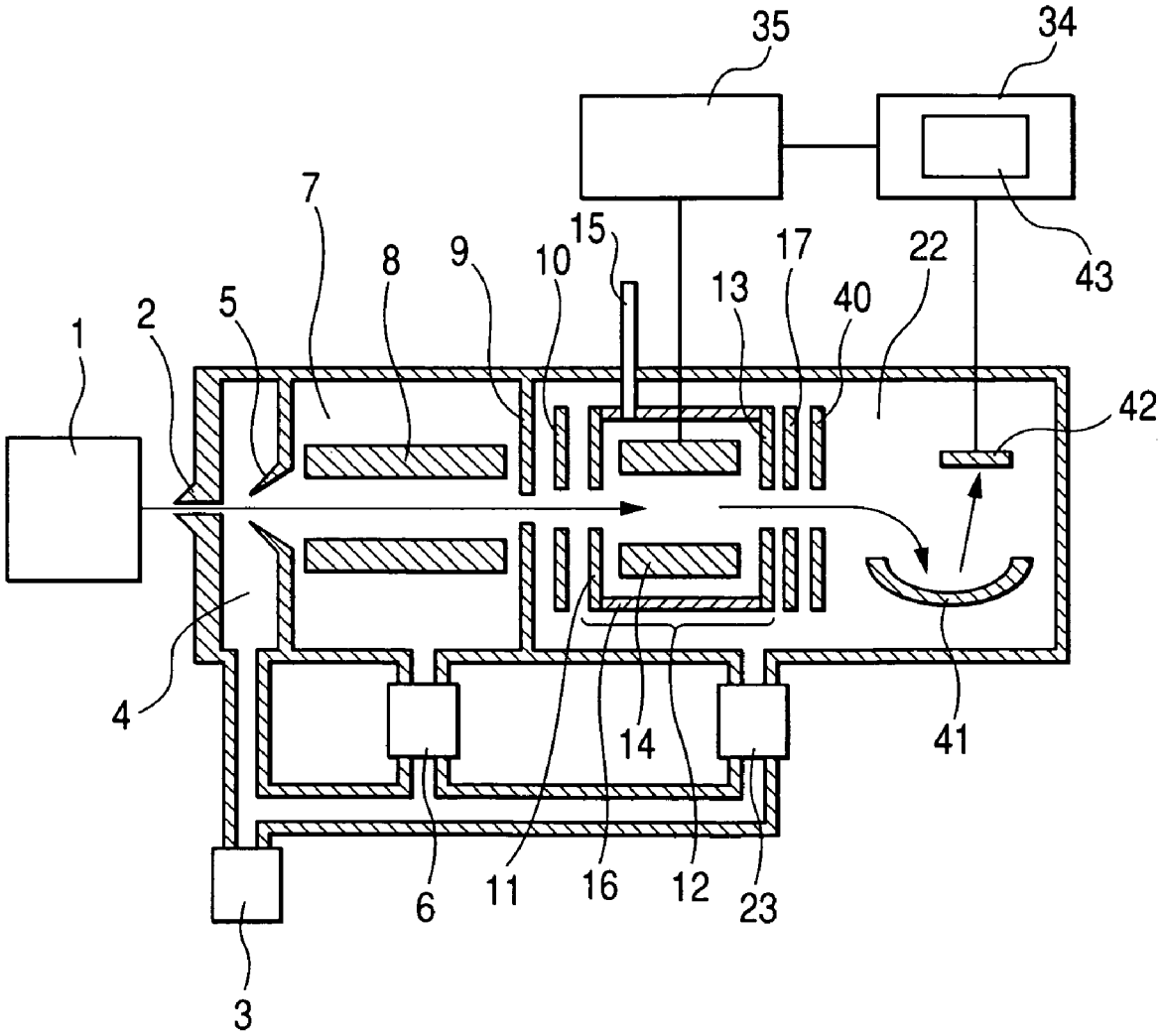
FIG. 12 is a drawing illustrating a second embodiment of the present invention.

FIG. 12 shows a block diagram of the quadrupole linear ion trap mass spectrometer according to the present invention.

The ions produced in the ion source 1 are led through the aperture 2 into the first differential pumping region 4 from which air is exhausted by the rotary pump 3 to a pressure of about 100-500 Pa. Then, the ions proceed through the aperture 5 and into the second differential pumping region 7 which is exhausted by the turbo molecular pump 6. The second differential pumping region 7 is provided with the multipole electrode 8 and is maintained at a pressure of about 0.3-3 Pa. To the multipole electrode 8, the alternately phase-reversing frequency of about 1 MHz and the RF voltage with the voltage amplitude of several hundred volts are applied. In the multipole electrode 8, the ions are converged to around the center axis for highly efficient transport.

The ions converged by the multipole electrode 8 are led through the aperture 9, and the holes of the gate electrodes 10 and the incap electrodes 11 into the linear ion trap 12. The linear ion trap 12 comprises the incap electrodes 11, the endcap electrodes 13, and the quadrupole rod electrode 14. Into the linear ion trap 12, helium or other neutral gas is introduced through the piping 15. The linear ion trap 12 constitutes the inside of the case 16 with its pressure maintained at 0.03-0.3 Pa. The linear ion trap 12 is located in the vacuum chamber 22, which is exhausted by the turbo molecular pump 23 to maintain a pressure of about $1\times10^{-3}$ Pa. The ions that have undergone the periods of accumulation, isolation, and dissociation are then brought through the hole of the endcap electrodes 13 and ejected out of the linear ion trap 12.

The ejected ions pass through the ion stop electrodes 17 and the focus electrodes 40, collide against the conversion dynode 41 so as to be converted into electrons, and reach the detector 42 for detection. The data detected at the detector 42 are to be stored in the storage unit 43 located in the controller 34.

The operational control of the linear ion trap 12 is carried out by the controller 34. Preset in the controller 34, the reference voltage conditions for the ion mass which is made the target in each period of accumulation, isolation, dissociation, or ejection are preset and stored in the storage unit 43, for example, in the form of table. The controller 34 also controls the power source 35 in accordance with the preset voltage conditions.

The method of applying voltage to the linear ion trap 12 in the configuration shown in FIG. 12 is essentially the same as FIG. 3.

Figure 13:
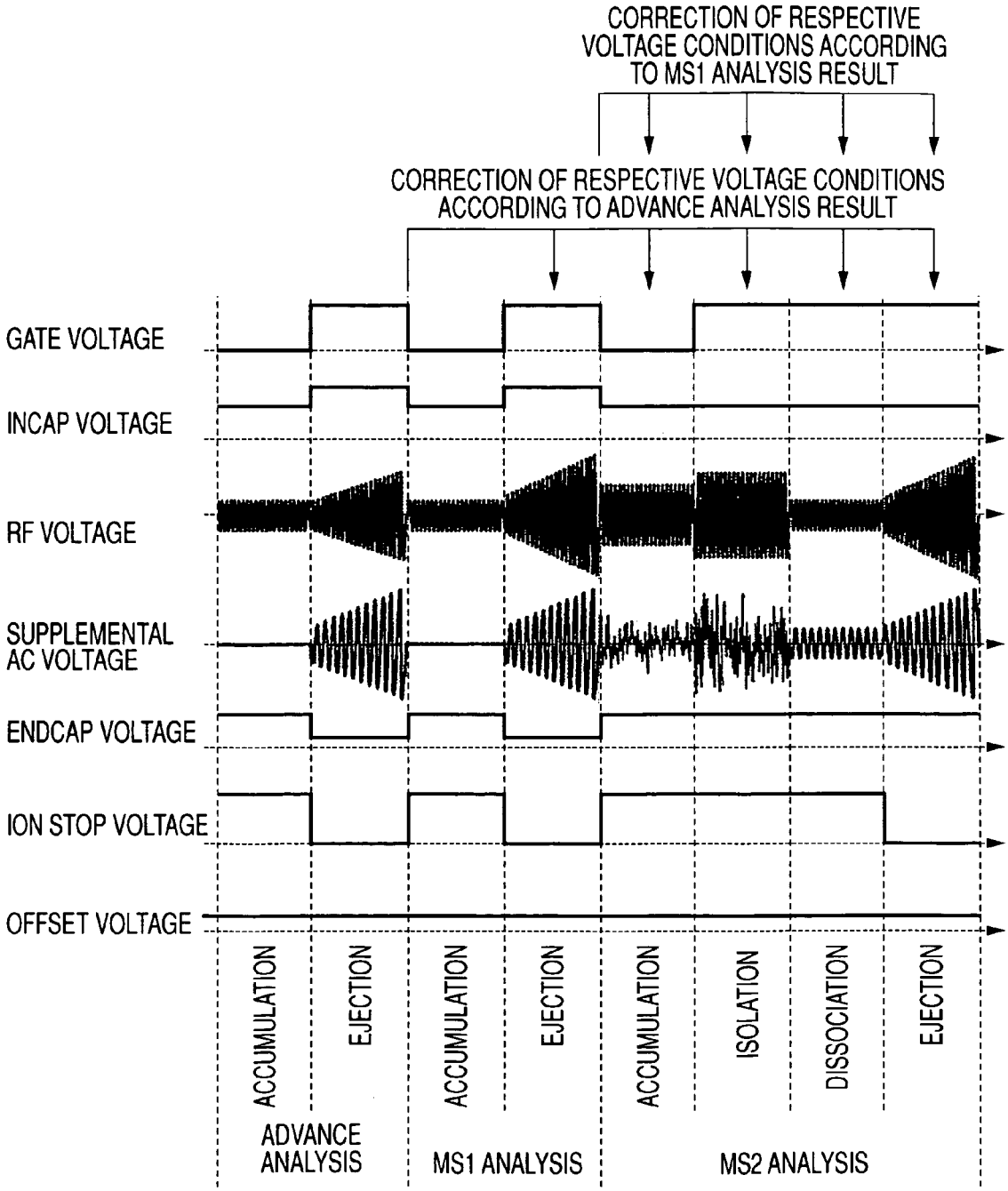
FIG. 13 is an operational sequence diagram of the second embodiment.

In the next place, FIG. 13 is used to explain about the operational sequence for each electrode when MSn analysis is made by means of the configuration shown in FIG. 12. The operational sequence diagram of FIG. 13 represents the performance of MS2 analysis. In MS2 analysis, the linear ion trap 12 conducts ion accumulation and ejection in the advance analysis process; conducts ion accumulation and ejection in MS1 analysis, viz., the first mass spectrometry process; and further conducts ion accumulation, isolation, dissociation, and ejection in MS2 analysis, viz., the second mass analysis process. What is different from the operational sequence diagram of FIG. 4 is that advance analysis is carried out before the ejection period in MS1 and MS2 and also before MS1 analysis. Except for the aforementioned point, the voltage conditions for each electrode and the conditions on time span are basically the same with FIG. 4. Therefore, only the points of difference are to be explained herein after.

In the beginning, explanation is given with respect to MS1 ion ejection period. In MS1 ion ejection period, the incap voltage and the endcap voltage are set at 30 V, and while trap potential is maintained as such, the RF voltage and the supplemental AC voltage applied to the quadrupole rod electrode 14 are to be scanned from a low value to a high value. By this scanning, the ions in the linear ion trap 12 are to be ejected through the hole of the endcap electrodes 13 in the order of the mass-to-charge ratio. The ejected ions are sequentially detected by the detector 42, and depending on detection signal intensity at each mass value, the mass spectrums are taken into the controller 34. In MS1 ion ejection period, the gate voltage is set at a high value (50 V) so as to prevent ions from entering the linear ion trap 12, while the ion stop voltage is set at a low value so as to let ions pass through the ion stop electrodes 17 at an enhanced efficiency. The time span required for scanning of ions depends on the range of the target ion mass, but normally scanning is carried out at a speed of around 200 μs/amu (amu=atomic mass unit).

The voltage condition for MS2 ion ejection period is similar to that for MS1 ion ejection period; the ions fragmented in the dissociation period are ejected in the order of the mass-to-charge ratio and processed for mass spectrometry. As in the case of the first embodiment, the state of the mass spectrum obtainable from fragment ions can provide analysis on structural data in more detail than available from the mass spectrum in MS1 analysis.

In the ion ejection period, the mass spectrometry is conducted by scanning of the RF voltage and the supplemental AC voltage. Under the influence of space charge that may be caused thereby depending on the accumulated volume of ions in the linear ion trap 12, the voltage that ions actually receive becomes apparently lower than the preset voltage, resulting in some degradation in precision. If the mass spectrum of MS1 analysis is not enough in point of mass precision, the subsequent MS2 analysis also becomes degraded to some extent in the performance of mass selectivity.

It is to solve the above problem that the system of the present invention conducts an advance analysis before MS1 analysis and gets hold of the ion accumulation in the linear ion trap 12 by taking the mass spectrum.

Figure 14:
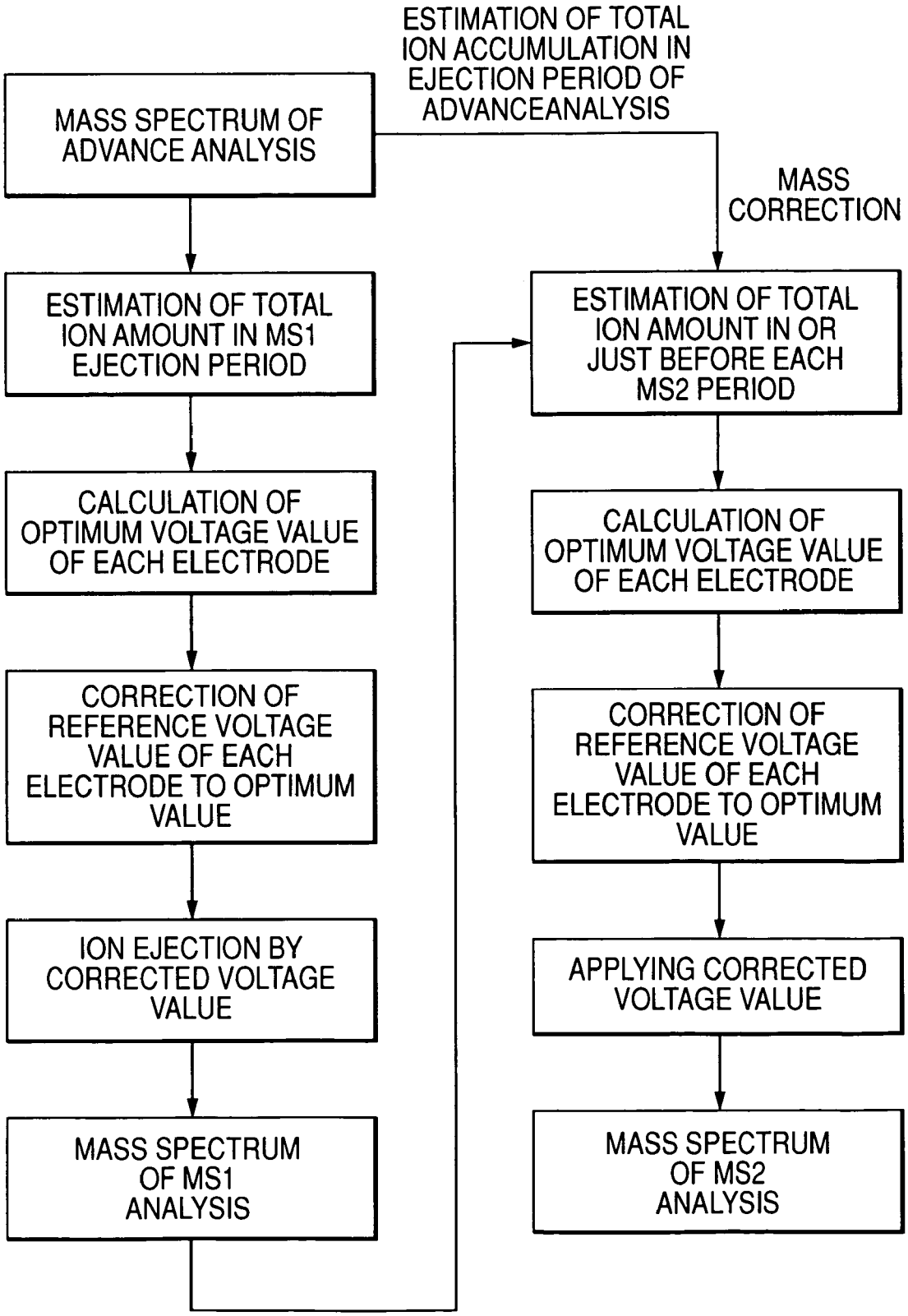
FIG. 14 is a flowchart of the second embodiment.

As shown in the flowchart of FIG. 14, firstly, the total ion accumulation in the linear ion trap 12 in MS1 ejection period is estimated on the basis of the mass spectrum of the advance analysis; secondly, according to such estimated total ion accumulation, the optimum voltage condition for each electrode is calculated; thirdly, at least one of the reference values of the voltage condition for each electrode preset for every m/z in the controller 34 is corrected to the optimum value; fourthly, the power source 35 and the linear ion trap 12 are controlled by the voltage condition after correction; and fifthly, the ejection of MS1 analysis is then consummated. Since this ion ejection of MS1 analysis is conducted on the voltage condition after correction, the mass spectrum of MS1 analysis can become available in high precision. It also becomes possible thereby to prevent degradation of mass precision in analyses after MS1.

Processing in the following manner is also possible: firstly, the total ion amount in the linear ion trap 12 in or just before each MS2 ejection period is estimated on the basis of the mass spectrum of the advance analysis; secondly, according to such estimated total ion accumulation, the optimum voltage condition for each electrode is calculated; thirdly, at least one of the reference values of the voltage condition for each electrode preset for every m/z in the controller 34 is corrected to the optimum value; fourthly, the power source 35 and the linear ion trap 12 are controlled by the voltage condition after correction. Since in this case the ion ejection of the advance analysis is conducted on the voltage condition before correction, the mass spectrum cannot be obtained in high precision. Therefore, it becomes necessary firstly to estimate the total ion accumulation in the linear ion trap 12 in the ejection period of the advance analysis, secondly to estimate a shift amount of the mass axis (corresponding to voltage condition) of the mass spectrum in relation to the estimated ion accumulation, and thirdly to set up the target mass range in each period of MS2 analysis with reference to the mass axis corrected with the above shift amount taken into consideration.

Further, the configuration shown in FIG. 12 also makes it possible in the same way as the first embodiment, firstly that the total ion accumulation in the linear ion trap 12 in or just before each MS2 period is estimated with reference to the mass spectrum of MS1 analysis, secondly that the optimum voltage condition for each electrode is calculated based on such estimated total ion accumulation, thirdly that at least one of the reference values of the voltage condition for each electrode preset for every m/z in the controller 34 is corrected to the optimum value, and fourthly that the power source 35 and the linear ion trap 12 are controlled by the voltage condition after correction.

The present invention is able to control the effect of space charge without changing the time span for MS2 ion accumulation, thereby realizing high-sensitivity analysis and high ion selectivity. Estimation of the total ion accumulation is conducted on the basis of the mass spectrum obtained from the advance analysis or MS1 analysis and by comparing the time spans of MS1 ejection period and each MS2 period, LMCO, and the notch width (mass range) of the supplemental AC voltage with the conditions of the advance analysis or MS1 accumulation period.

Third Embodiment

Figure 15:
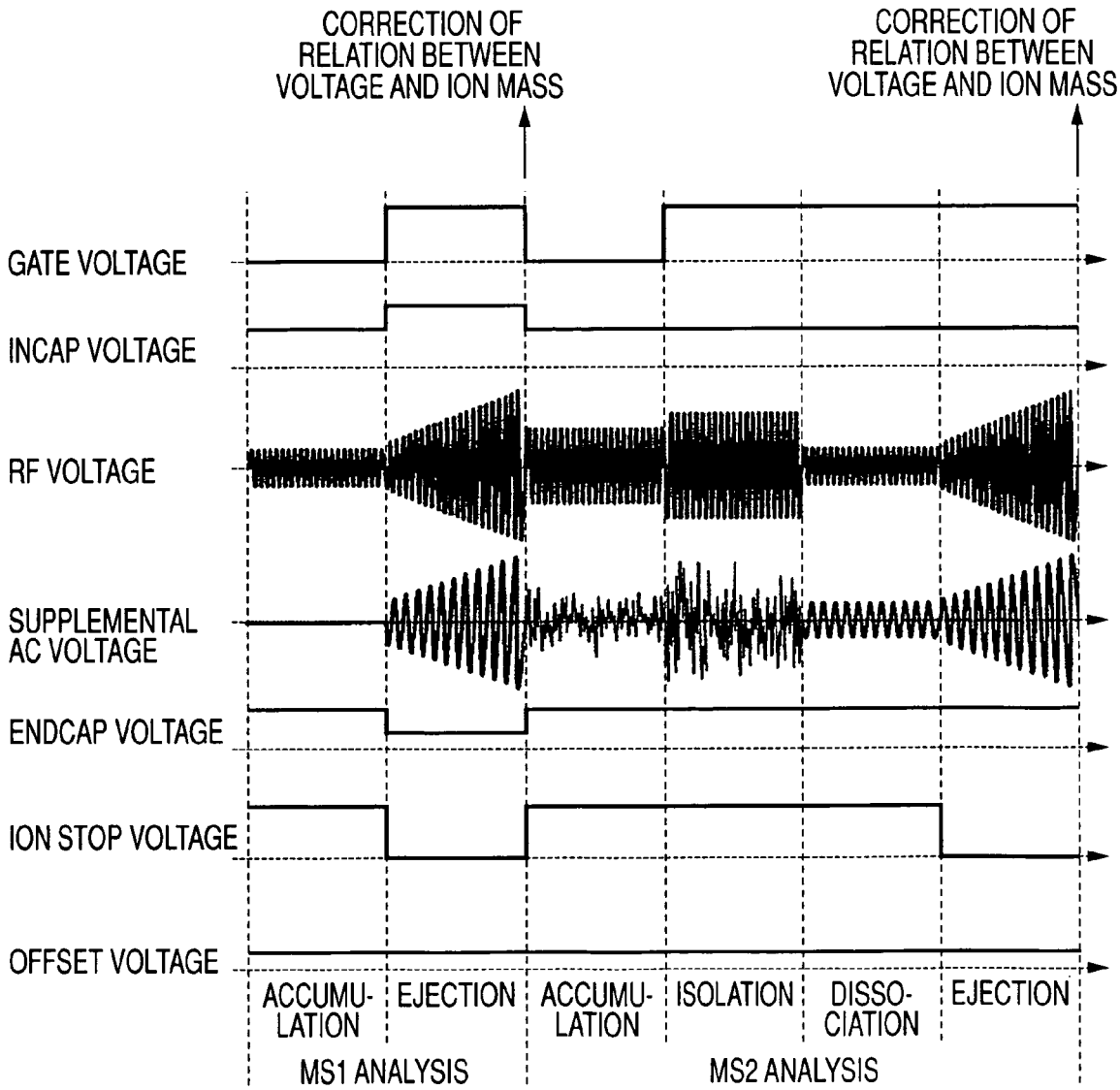
FIG. 15 is an operational sequence diagram of a third embodiment.

In a similar configuration to what is shown in FIG. 12, an embodiment or the third embodiment which employs a system different from the second embodiment is explained by using the operational sequence diagram of FIG. 15. The operational sequence diagram of FIG. 15 represents the performance of MS2 analysis. In MS2 analysis, the linear ion trap 12 conducts ion accumulation and ejection in the advance analysis process; conducts ion accumulation and ejection in MS1 analysis, viz., the first mass spectrometry process; and further conducts ion accumulation, isolation, dissociation, and ejection in MS2 analysis, viz., the second mass analysis process. What is different from the operational sequence diagram of FIG. 13 is that no advance analysis exists.

As explained for the second embodiment, in the ion ejection period, the mass spectrometry is conducted by scanning of the RF voltage and the supplemental AC voltage. Under the influence of space charge that may be caused thereby depending on the accumulated volume of ions in the linear ion trap 12, the voltage that ions actually receive becomes apparently lower than the preset voltage, resulting in some degradation in precision. If the mass spectrum of MS1 analysis is not enough in point of mass precision, the subsequent MS2 analysis also becomes degraded to some extent in the performance of mass selectivity.

When ions are ejected out of the linear ion trap 12 by scanning of the RF voltage and the supplemental AC voltage, those ions having a mass corresponding to the voltage condition at each instant are sequentially ejected. The timing (time) when those sequentially ejected ions are detected by the detector 42, and the ion intensity that are detected at the same timing; these data are to be recorded in the storage unit 43 located in the controller 34. The time data thus obtained can be converted to the voltage condition at that instant, that is, the ion mass. By plotting the ion mass on the horizontal axis and the ion intensity at each instant (each ion mass) on the vertical axis, the data can be converted into the mass spectrum.

Figure 16:
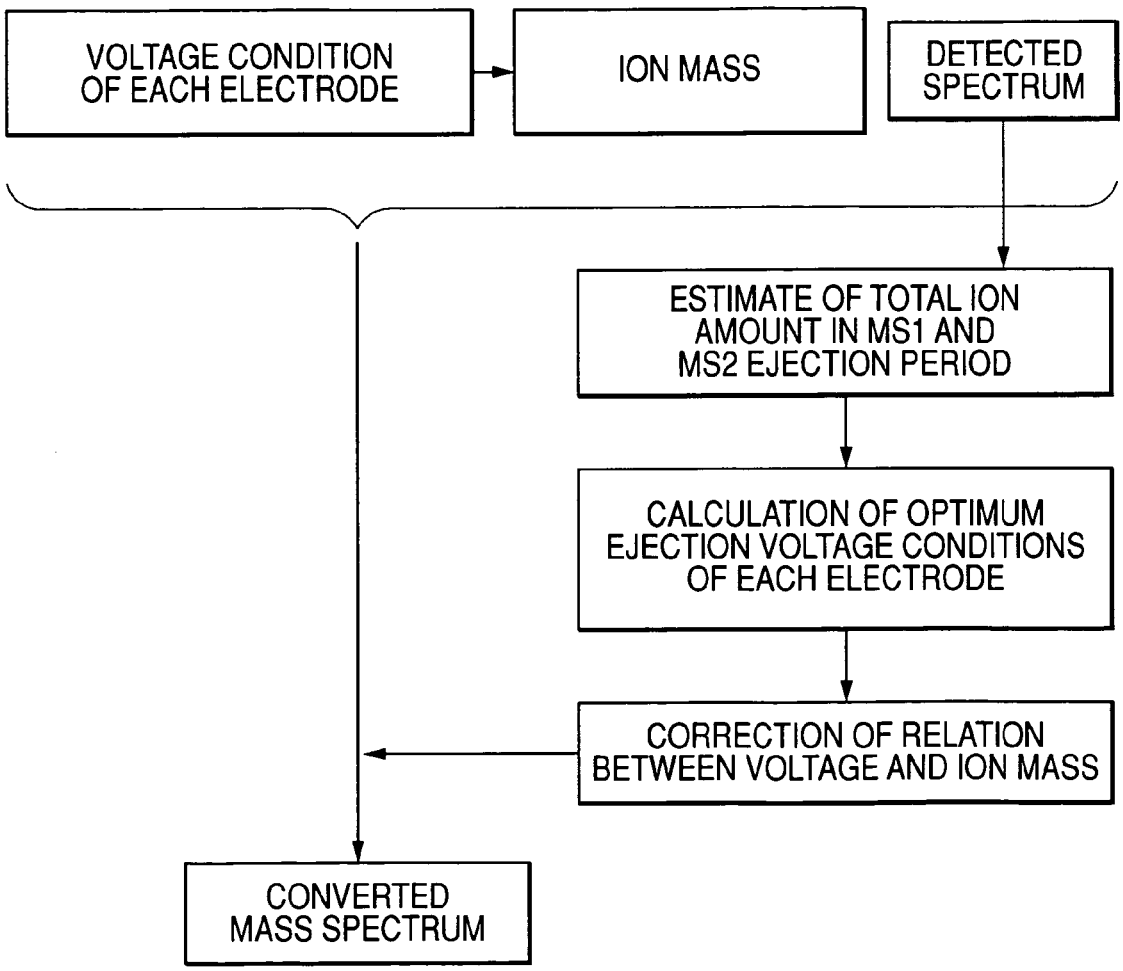
FIG. 16 is a flowchart of the third embodiment.

The ion accumulation in the linear ion trap 12, depending on volume, involves the problem of decreased mass precision. As shown in the flowchart of FIG. 16 indicating how to prevent the above problem, this system of the present invention conducts correction before the relation between the voltage condition at the ion detecting timing and the ion mass corresponding to that voltage condition, both available from MS1 and MS2 ejection periods, is converted into the mass spectrum. Actually, the total ion accumulation in the linear ion trap 12 in the ejection period is estimated from the detected ion volume obtainable from MS1 and MS2 ejection periods; according to such estimated total ion accumulation, the optimum ion ejection voltage condition for each electrode to match with the ion mass is calculated; at least one of the reference values of the voltage condition for each electrode preset for every m/z in the controller 34 is corrected; and finally the relation between the voltage and the ion mass is corrected.

The present invention, in the configuration similar to what is shown in FIG. 12, can control the effect of space charge even if no advance analysis period is exercised, and contribute to realizing high-sensitivity analysis and high ion selectivity performance.

Since the system of the present invention adopts the method of correcting the apparent voltage, the second embodiment proves to be as effective as the first embodiment and is able to realize high-sensitivity as well as high ion selectivity.

The system adopted in the present invention is valid and effective for various configurations, such as:

(1) a configuration (LIT-TOFMS) of the linear ion trap (LIT) of the first embodiment combined with the time-of-flight mass spectrometer (TOFMS);

(2) a configuration of the linear ion trap mass spectrometer (LITMS) of the first and second embodiments;

(3) a configuration (LIT-FT-ICRMS) of LIT combined with Fourier transform ion cyclotron resonance mass spectrometer (FT-ICRMS);

(4) a configuration of the three dimensional quadrupole ion trap mass spectrometer (QITMS) which uses the three dimensional quadrupole ion trap (QIT) for the ion trap section;

(5) a configuration (QIT-TOFMS) of QIT combined with TOFMS;

(6) a configuration (QIT-FT-ICRMS) of QIT combined with FT-ICRMS; and (7) other configurations in which the RF voltage, the supplemental AC voltage, and the DC voltage are used to control the ion trap.

What is claimed is:

1. A mass spectrometer comprising:

a linear ion trap to implement accumulation, isolation, dissociation, and ejection periods for the ion generated in an ion source;

a detector to detect the ion ejected from said ion trap;

a power supply to apply at lease one of RF voltage, supplemental AC voltage, and DC voltage to said ion trap; and a controller to control voltage values of said power supply and said ion trap, wherein said controller sets the ion trap, the power supply and the detector to sequentially execute ion accumulation and ejection periods during a first mass spectrometry analysis ("MS1 analysis"), and then to sequentially execute ion accumulation, isolation, dissociation, and ejection periods during a second mass spectrometry analysis ("MS2 analysis") subsequent to the first mass spectrometry analysis, in the ion accumulation period of the MS1 analysis, ions are accumulated near an center axis of the ion trap, and then ions lighter than a first low mass cut off (LMCO) are ejected out of the ion trap to leave only precursor ions therein, in the ion ejection period of the MS1 analysis, said precursor ions are ejected out of the ion trap into a collisional damping chamber to subject to a first mass spectrometry in the chamber, in the ion accumulation period of the MS2 analysis, ions accumulated and saturated in the ion trap are subject to a supplemental AC voltage to resonant-oscillate the ions and to eject ions outside of a target mass range out of the ion trap, in the ion isolation period of the MS2 analysis, ions remaining in the ion trap are accumulated near the center axis of the ion trap, ions remaining in the ion trap and lighter than a second LMCO are ejected out of the ion trap, the second LMCO being higher than the first LMCO, in the ion dissociation period of the MS2 analysis, ions remaining in the ion trap are applied with another supplemental AC voltage to dissociate the ions into fragmented ions, in the ion ejection period of the MS2 analysis, said fragmented ions are ejected out of the ion trap into the collisional damping chamber to subject to a second mass spectrometry in the chamber, said controller sets said voltage value for at least one of said periods of said ion trap in the second mass spectrometry, on the basis of an ion amount in or just before said at least one period of said ion trap as calculated based on a measurement result of the first mass spectrometry.

2. The mass spectrometer according to claim 1, wherein said controller has a storage unit in which reference voltage value data for each mass-to-charge ratio is stored.

3. The mass spectrometer according to claim 1, wherein said controller has a function or table concerning a correction value of voltage from a reference voltage value corresponding to an ion amount.

4. The mass spectrometer according to claim 1, wherein said ion amount is calculated by the following formula:

$$Q = \int^{\Delta m} I(m)dm \cdot \frac{T_{ms2}}{T_{MS1}}$$

where,

Q: Ion amount

Δm: Target mass range in the second mass spectrometry $T_{MS1}$: Accumulation period in the first mass spectrometry $T_{ms2}$: Ion accumulation measurement in the second mass spectrometry.

5. The mass spectrometer according to claim 1, wherein said controller has a function or table for each of said RF voltage, supplemental AC voltage, and DC voltage.

6. The mass spectrometer according to claim 1, wherein said ion trap is a quadrupole linear ion trap.

7. The mass spectrometer according to claim 1, wherein said controller sets a voltage value of said ejection period in said first mass spectrometry based on an ion amount detected in said ejection period in said first mass spectrometry calculated according to a measurement result of an advance spectrometry preceding to the first mass spectrometry.

8. The mass spectrometer according to claim 1, wherein said detector calculates said ion amount based on an ion content detected in said first mass spectrometry and said second spectrometry and, according to said calculated ion amount, makes correction of a relation between voltage and ion mass at an ion detection timing of said detector.

9. The mass spectrometer according to claim 1, wherein via the ion isolation period of the MS2 analysis, ions are isolated within a range ±1 m/z or smaller from a target mass-to-charge ratio (m/z).

10. A mass spectrometer comprising:

a linear ion trap to implement accumulation, isolation, dissociation, and ejection periods for the ion generated in an ion source;

a detector to detect the ion ejected from said ion trap;

a power supply to apply at least one of RF voltage, supplemental AC voltage, and DC voltage to said ion trap; and a controller to control voltage values of said power supply and said ion trap, wherein said controller sets at least one of said voltage values to operate the mass spectrometer to sequentially execute ion accumulation and ejection periods during a first mass spectrometry analysis and then to sequentially execute ion accumulation, isolation, dissociation, and ejection periods during a second mass spectrometry analysis while setting one of the voltage values for at least one of said periods of said ion trap during the second mass spectrometry analysis, on the basis of an ion amount calculated based on a measurement result of the first mass spectrometry analysis.

11. The mass spectrometer according to claim 10, wherein said controller has a storage unit in which reference voltage value data for each mass-to-charge ratio is stored.

12. The mass spectrometer according to claim 10, wherein said controller has a function or table concerning a correction value of voltage from a reference voltage value corresponding to an ion amount.

13. The mass spectrometer according to claim 10, wherein said ion amount is calculated by the following formula:

$$Q = \int^{\Delta m} I(m)dm \cdot \frac{T_{ms2}}{T_{MS1}}$$

where,

Q: Ion amount

Δm: Target mass range in the second mass spectrometry $T_{MS1}$: Accumulation period in the first mass spectrometry $T_{ms2}$: Ion accumulation measurement in the second mass spectrometry.

14. The mass spectrometer according to claim 10, wherein said controller has a function or table for each of said RF voltage, supplemental AC voltage, and DC voltage.

15. The mass spectrometer according to claim 10, wherein said ion trap is a quadrupole linear ion trap.

16. The mass spectrometer according to claim 10, wherein said controller sets a voltage value of said ejection period in said first mass spectrometry based on an ion amount detected in said ejection period in said first mass spectrometry calculated according to a measurement result of an advance spectrometry preceding to the first mass spectrometry.

17. The mass spectrometer according to claim 10, wherein said detector calculates said ion amount based on an ion content detected in said first mass spectrometry and said second spectrometry and, according to said calculated ion amount, makes correction of a relation between voltage and ion mass at an ion detection timing of said detector.

18. The mass spectrometer according to claim 10, wherein via the ion isolation period of the MS2 analysis, ions are isolated within a range ±m/z or smaller from a target mass-to-charge ratio (m/z).

* * * * *